US010272692B2

(12) United States Patent
Hara et al.

(10) Patent No.: US 10,272,692 B2
(45) Date of Patent: Apr. 30, 2019

(54) LIQUID CIRCULATION DEVICE, LIQUID EJECTION APPARATUS, AND LIQUID EJECTION METHOD

(71) Applicant: TOSHIBA TEC KABUSHIKI KAISHA, Tokyo (JP)

(72) Inventors: Kazuhiro Hara, Numazu Shizuoka (JP); Kazuhiko Ohtsu, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/682,936

(22) Filed: Aug. 22, 2017

(65) Prior Publication Data

US 2018/0072069 A1 Mar. 15, 2018

(30) Foreign Application Priority Data

Sep. 13, 2016 (JP) ..... 2016-178773
Jul. 25, 2017 (JP) ..... 2017-143838

(51) Int. Cl.
*B41J 2/18* (2006.01)
*B41J 2/045* (2006.01)
(Continued)

(52) U.S. Cl.
CPC ..... *B41J 2/18* (2013.01); *B41J 2/04541* (2013.01); *B41J 2/175* (2013.01); *B41J 2/17566* (2013.01); *B41J 2/17596* (2013.01); *B41J 29/38* (2013.01)

(58) Field of Classification Search
CPC . B41J 2/18; B41J 2/04541; B41J 2/175; B41J 2/17566; B41J 2/17596
See application file for complete search history.

(56) References Cited

U.S. PATENT DOCUMENTS 8,132,901 B2 3/2012 Bansyo
2006/0139414 A1* 6/2006 Iwashita ..... B41J 2/14233 347/68

(Continued)

FOREIGN PATENT DOCUMENTS

EP 2050572 A2 4/2009
EP 2990211 A2 3/2016
EP 2995458 A1 3/2016

OTHER PUBLICATIONS

Extended European Search Report dated Jan. 31, 2018, dated counterpart European Application No. 17190477.4, 12 pages.

*Primary Examiner* — Jason S Uhlenhake
(74) *Attorney, Agent, or Firm* — Kim & Stewart LLP

(57) ABSTRACT

A liquid circulation device includes a circulation path through which a liquid circulates through a liquid ejection head, a first pump in the circulation path on a first side of the liquid ejection head, a second pump in the circulation path on a second side of the liquid ejection head, an adjustment tank in the circulation path between the first pump and the second pump, an upstream tank in the circulation path between the liquid ejection head and the first pump, a downstream tank in the circulation path between the liquid ejection head and the second pump, a first pressure sensor configured to detect a pressure in the upstream tank, a second pressure sensor configured to detect a pressure in the downstream tank, and a controller configured to control the first and second pumps based on detected pressures in the upstream and downstream tanks.

17 Claims, 8 Drawing Sheets

(51) Int. Cl.
*B41J 2/175* (2006.01)
*B41J 29/38* (2006.01)

(56) References Cited

U.S. PATENT DOCUMENTS

| | | | | |
|---|---|---|---|---|
| 2007/0222832 | A1* | 9/2007 | Yahiro | B41J 2/175 347/85 |
| 2010/0079562 | A1 | 4/2010 | Katada et al. | |
| 2010/0245411 | A1 | 9/2010 | Kato et al. | |
| 2011/0007105 | A1 | 1/2011 | Kuribayashi et al. | |
| 2014/0292963 | A1 | 10/2014 | Hara et al. | |
| 2015/0174910 | A1 | 6/2015 | Kaneko | |
| 2015/0314607 | A1* | 11/2015 | Moriguchi | B05B 7/24 347/85 |
| 2017/0087864 | A1* | 3/2017 | Akishiba | B41J 2/18 |

* cited by examiner

LIQUID CIRCULATION DEVICE, LIQUID EJECTION APPARATUS, AND LIQUID EJECTION METHOD

CROSS-REFERENCE TO RELATED APPLICATION

This application is based upon and claims the benefit of priority from Japanese Patent Application No. 2016-178773, filed Sep. 13, 2016, and Japanese Patent Application No. 2017-143838, filed Jul. 25, 2017, the entire contents of each are incorporated herein by reference.

FIELD

Embodiments described herein relate generally to a liquid circulation device, a liquid ejection apparatus, and a liquid ejection method.

BACKGROUND

In an existing liquid ejection apparatus, a liquid ejection head ejects liquid and a liquid circulation device circulates the liquid through a circulation path. The liquid ejection apparatus adjusts a liquid pressure of a nozzle of the liquid ejection head by using a pump for adjusting the pressure in a plurality of tanks provided in the circulation path. However, if the capacity of the pump changes over time, it is difficult to adjust the liquid pressure.

DETAILED DESCRIPTION

In general, according to one embodiment, A liquid circulation device includes a circulation path through which a liquid circulates through a liquid ejection head, a first pump in the circulation path on a first side of the liquid ejection head, a second pump in the circulation path on a second side of the liquid ejection head, an adjustment tank in the circulation path between the first pump and the second pump, an upstream tank in the circulation path between the liquid ejection head and the first pump, a downstream tank in the circulation path between the liquid ejection head and the second pump, a first pressure sensor configured to detect a pressure in the upstream tank, a second pressure sensor configured to detect a pressure in the downstream tank, and a controller connected to the first and second pumps and configured to control the first and second pumps based on detected pressures in the upstream and downstream tanks.

First Embodiment

Figure 1:
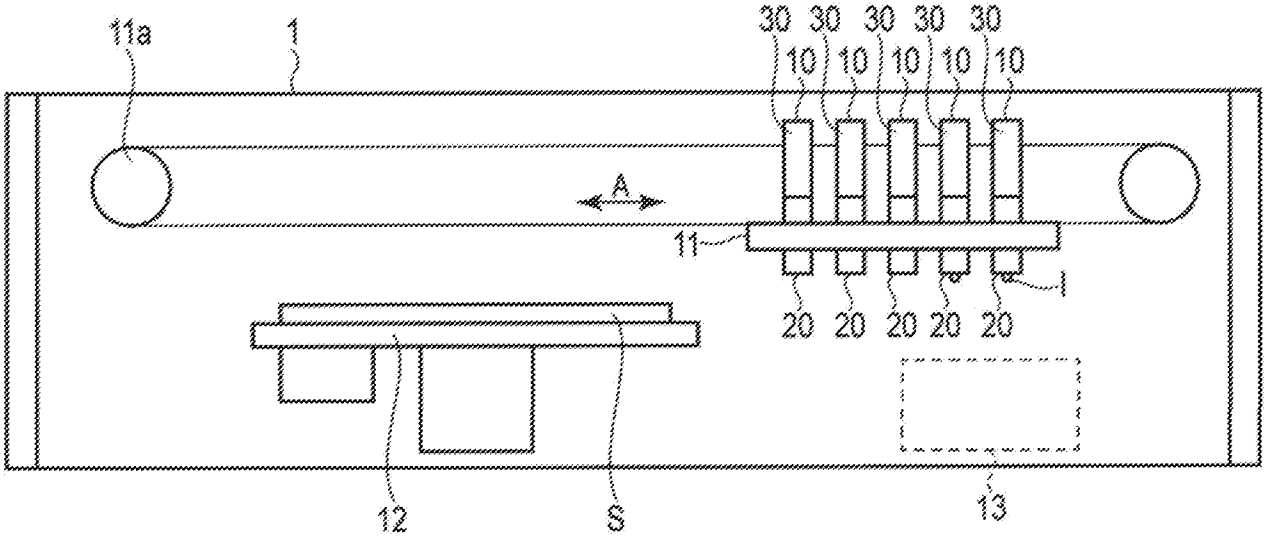
FIG. 1 is a side view illustrating a configuration of an ink jet recording apparatus according to an embodiment.
Figure 2:
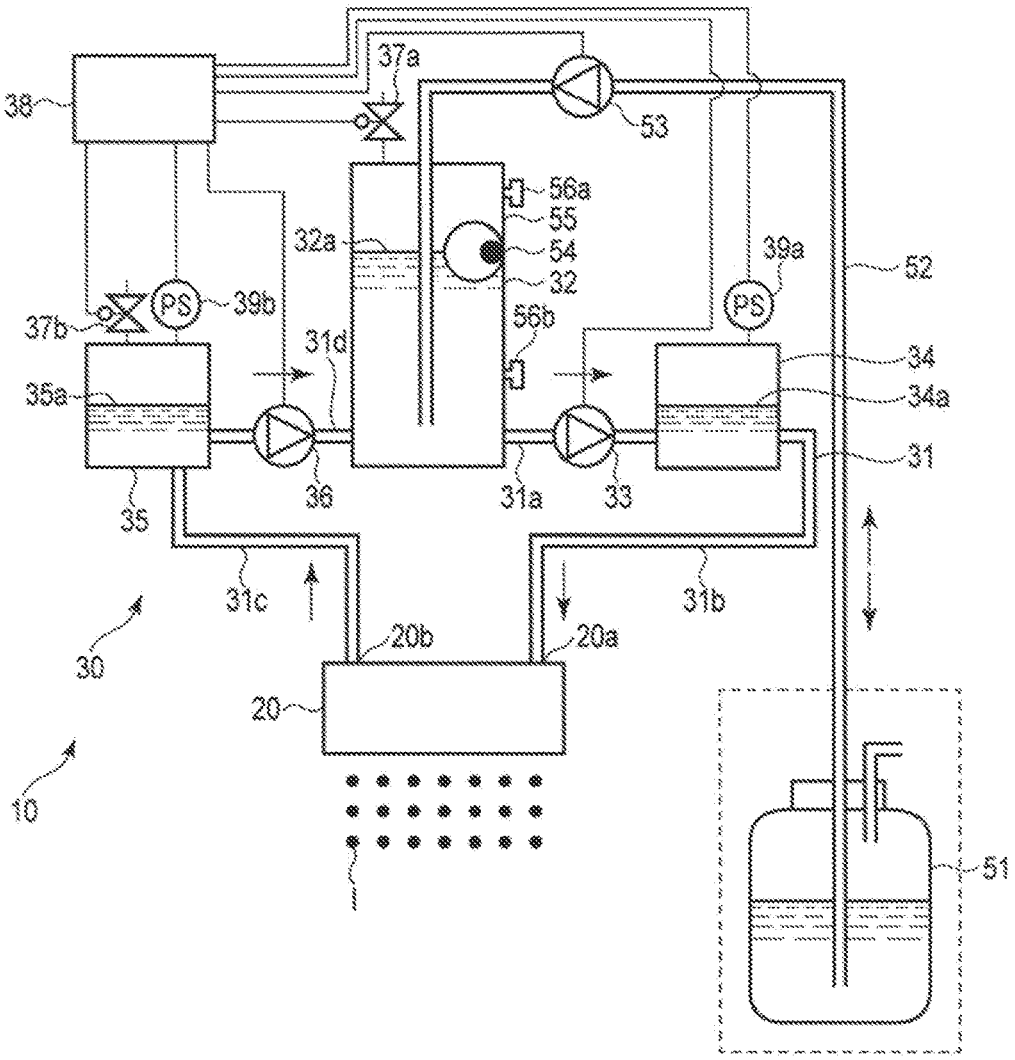
FIG. 2 is an explanatory diagram illustrating a configuration of a liquid ejection apparatus according to the embodiment.
Figure 3:
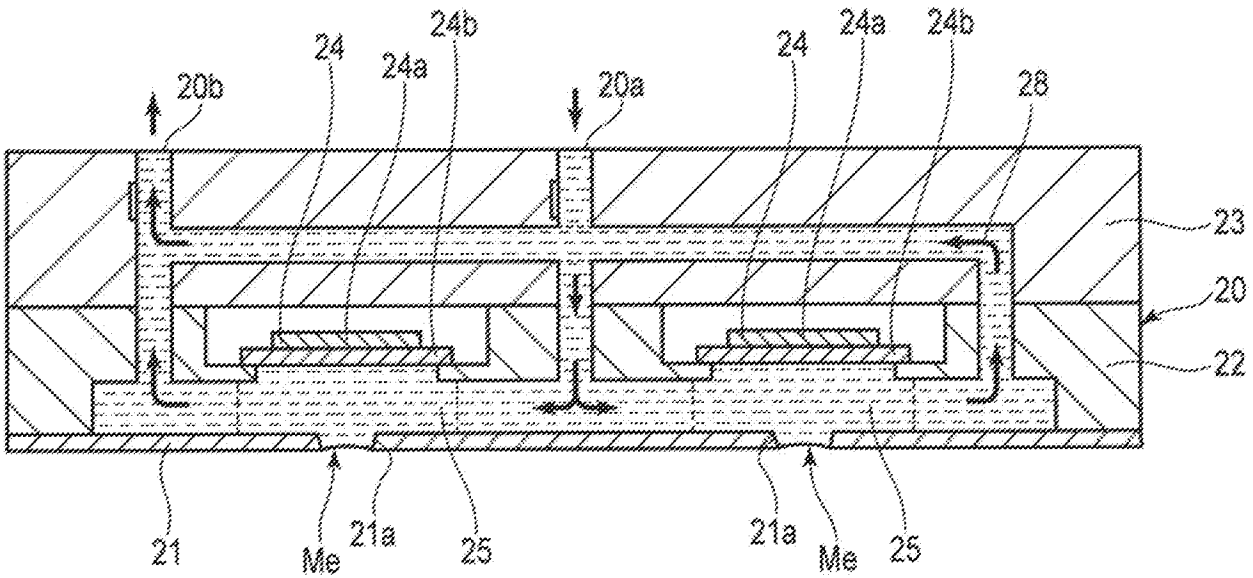
FIG. 3 is an explanatory diagram illustrating a configuration of a liquid ejection head of the liquid ejection apparatus.
Figure 4:
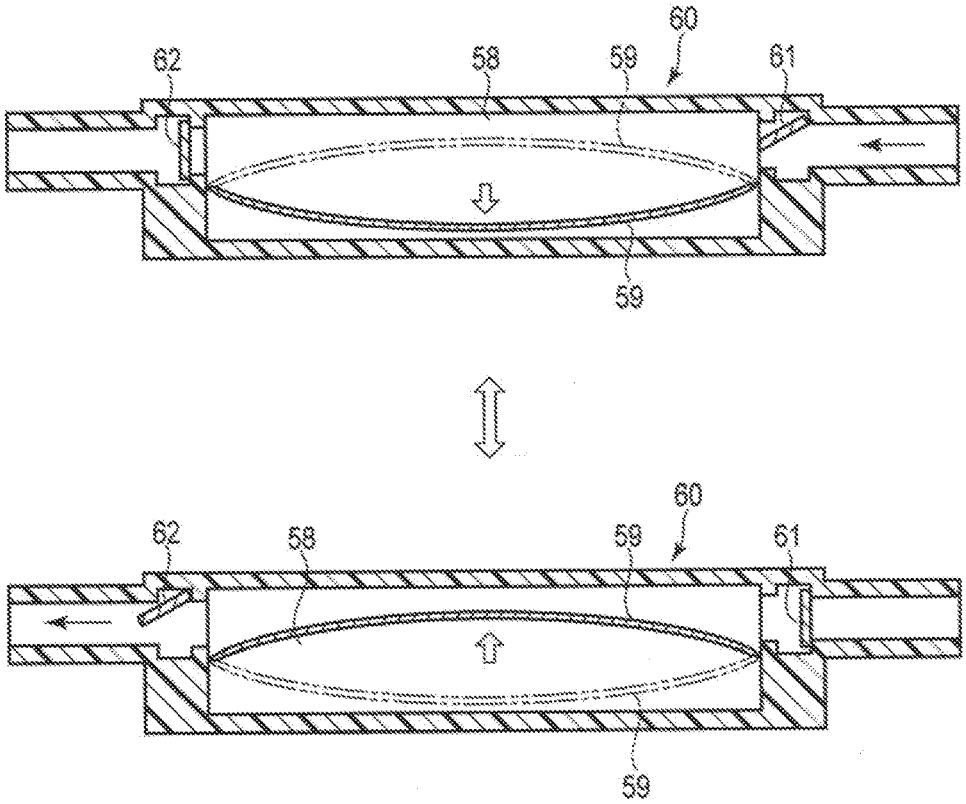
FIG. 4 is an explanatory diagram illustrating a configuration of a piezoelectric pump of the liquid ejection apparatus.
Figure 5:
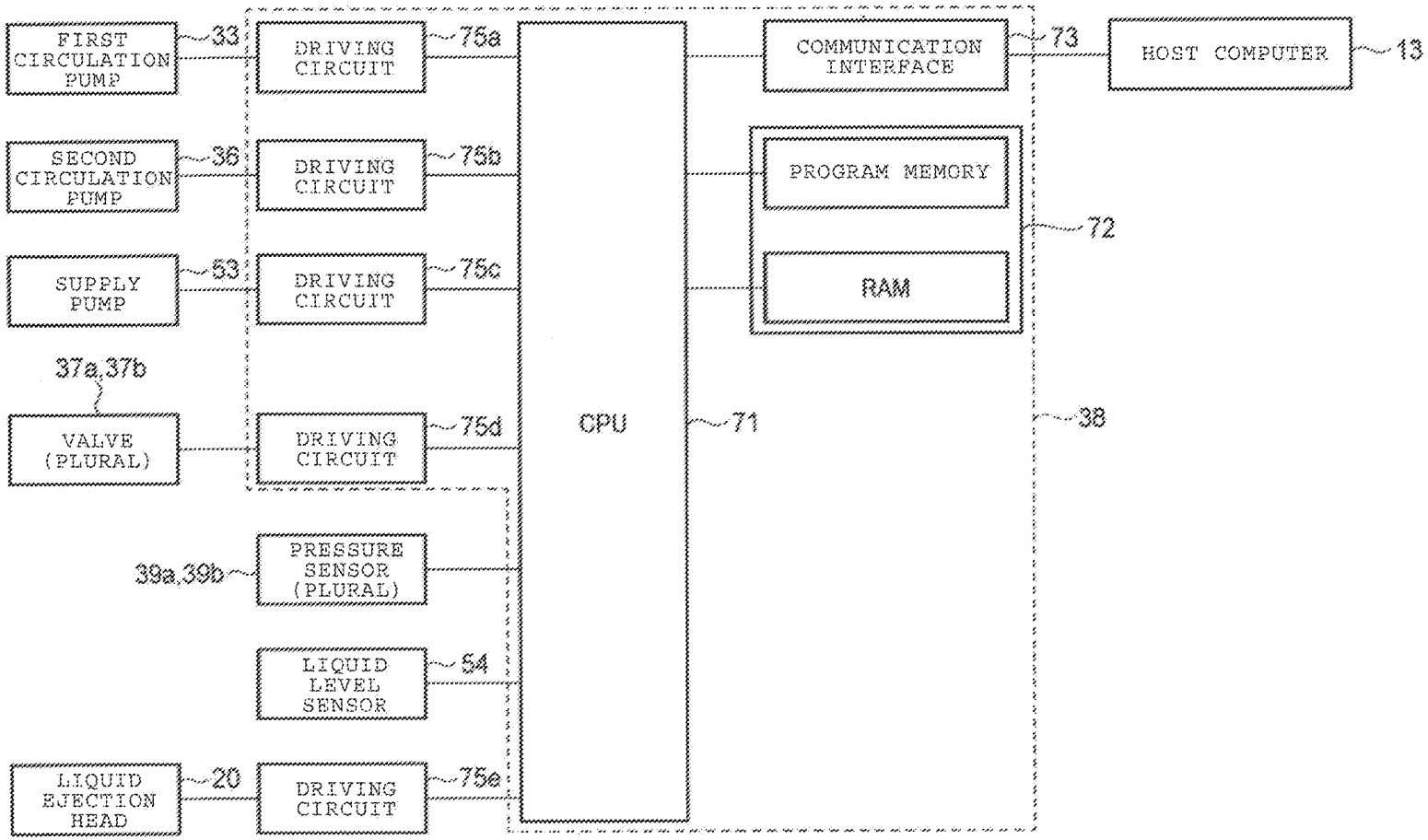
FIG. 5 is a block diagram illustrating a configuration of a control unit of a liquid ejection apparatus.
Figure 6:
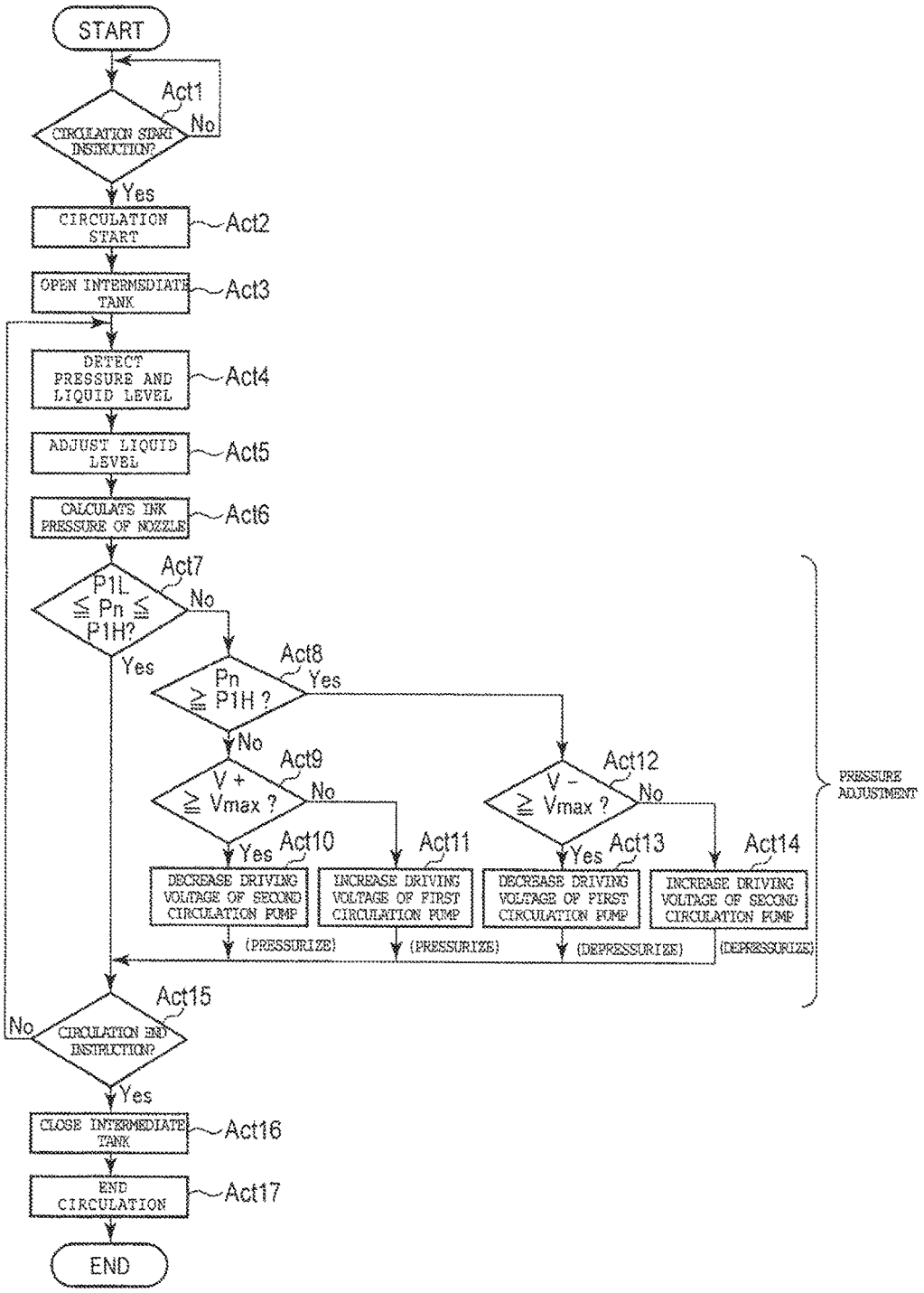
FIG. 6 is a flowchart illustrating a control method of the liquid ejection apparatus.

Hereinafter, a liquid ejection apparatus 10 according to an example embodiment and an ink jet recording apparatus 1 including the liquid ejection apparatus 10 will be described with reference to FIGS. 1 to 6. For the purpose of explanation of components illustrated in FIGS. 1 to 6, the components may be appropriately enlarged, reduced or omitted. FIG. 1 is a side view illustrating a configuration of the inkjet recording apparatus 1. FIG. 2 is an explanatory diagram illustrating a configuration of the liquid ejection apparatus 10. FIG. 3 is an explanatory diagram illustrating a configuration of a liquid ejection head 20. FIG. 4 is an explanatory diagram illustrating configurations of a first circulation pump 33, a second circulation pump 36, and a supply pump 53. FIG. 5 is a block diagram illustrating a module control unit 38 of the liquid ejection apparatus 10. FIG. 6 is a flowchart illustrating a control method of the liquid ejection apparatus 10.

The ink jet recording apparatus 1 illustrated in FIG. 1 includes a plurality of liquid ejection apparatuses 10, a head support mechanism 11 that supports and moves the liquid ejection apparatuses 10, a medium support mechanism 12 that supports and moves a recording medium S, and a host computer 13.

As illustrated in FIG. 1, the plurality of liquid ejection apparatuses 10 are disposed in parallel in one direction, and are supported by the head support mechanism 11. A liquid ejection head 20 and a circulation device 30 are integrated in the liquid ejection apparatus 10. The liquid ejection apparatus 10 ejects, for example, an ink I as liquid on the recording medium S facing the liquid ejection apparatus 10, and forms a desired image on the recording medium S.

The plurality of liquid ejection apparatuses 10 respectively eject inks of a plurality of colors, for example, a cyan ink, a magenta ink, a yellow ink, a black ink, and a white ink. The colors or characteristics of the inks I to be used are not limited. For example, instead of a white ink, a transparent glossy ink, a special ink which develops a color when the ink is irradiated with infrared rays or ultraviolet rays, or the like may be ejected. The plurality of liquid ejection apparatuses 10 have the same configuration and may use different inks.

The liquid ejection head 20 illustrated in FIG. 3 is an ink jet head, and includes a nozzle plate 21 having a plurality of nozzle holes 21*a*, a board 22, and a manifold 23 attached to the board 22. The board 22 is facing and attached to the nozzle plate 21. The board 22 is configured in a predetermined shape so as to form a predetermined-shaped ink flow path 28 including a plurality of ink pressure chambers 25 between the board 22 and the nozzle plate 21. An actuator 24 is provided on a portion of the board 22 that faces each of the ink pressure chambers 25. The board 22 includes partition walls disposed between the plurality of ink pressure chambers 25 in the same row. The actuator 24 is disposed so as to face the nozzle hole 21*a*, and the ink pressure chamber 25 is formed between the actuator 24 and the nozzle hole 21*a*.

In the liquid ejection head 20, the nozzle plate 21, the board 22, and the manifold 23 form the predetermined-shaped ink flow path 28 including the ink pressure chambers 25 therein. The actuator 24 including electrodes 24*a* and 24*b* is provided on the portion of the board 22 that faces each of the ink pressure chambers 25. The actuator 24 is connected to a driving circuit. The actuator 24 is deformed according to a voltage controlled by a module control unit 38, and thus the liquid ejection head 20 ejects the liquid from the nozzle hole 21*a* which is disposed so as to face the actuator 24.

As illustrated in FIG. 2, the circulation device 30 is integrated to an upper portion of the liquid ejection head 20 by a metal coupling component. The circulation device 30 includes a predetermined-shaped circulation path 31 configured to allow the liquid passing through the liquid ejection head 20 and circulating, an intermediate tank 32 as an adjustment tank, a first circulation pump 33, an upstream tank 34 as a first tank, a downstream tank 35 as a second tank, a second circulation pump 36, in this order in the circulation path 31. The circulation device 30 further includes a plurality of opening and closing valves 37 (when referring to particular opening and closing valves 37 within the plurality, particular valves may be referred to as opening and closing valve 37*a* or opening and closing valve 37*b*), and the module control unit 38 which controls a liquid ejection operation.

The circulation device 30 includes a cartridge 51 as a supply tank provided outside of the circulation path 31, a supply path 52, and a supply pump 53. The cartridge 51 is configured so as to store the ink to be supplied to the intermediate tank 32, and an air chamber in the cartridge 51 is opened to the atmosphere. The supply path 52 is a flow path that connects the intermediate tank 32 and the cartridge 51. The supply pump 53 is provided on the supply path 52, and feeds the ink in the cartridge 51 to the intermediate tank 32.

A first flow path 31*a*, a second flow path 31*b*, a third flow path, 31*c* and a fourth flow path 31*d* that constitute the circulation path 31 and the supply path 52 each include a pipe peripherally covered with a metal or a resin material and tubes, for example, Polytetrafluoroethylene (PTFE) tubes. The circulation path 31 includes the first flow path 31*a* which connects the intermediate tank 32 and the upstream tank 34, the second flow path 31*b* which connects the upstream tank 34 and a supply port 20*a* of the liquid ejection head 20, the third flow path 31*c* which connects a collection port 20*b* of the liquid ejection head 20 and the downstream tank 35, and the fourth flow path 31*d* which connects the downstream tank 35 and the intermediate tank 32.

The circulation path 31 extends from the intermediate tank 32 to the supply port 20*a* of the liquid ejection head 20 via the first flow path 31*a* and the second flow path 31*b*, and from the collection port 20*b* of the liquid ejection head 20 to the intermediate tank 32 via the third flow path 31*c* and the fourth flow path 31*d*.

The intermediate tank 32 is connected to the liquid ejection head 20 via the circulation path 31, and is configured so as to store the liquid. A separating film 32*a*, for example, polyimide or PTFE, is formed on a liquid surface of the intermediate tank 32 to prevent air bubbles from entering the intermediate tank 32. The intermediate tank 32 includes an opening and closing valve 37 configured to open an air chamber in the intermediate tank 32 to the atmosphere. Further, a liquid level sensor 54 is provided on the liquid surface of the intermediate tank 32.

The upstream tank 34 is disposed upstream of the liquid ejection head 20, and is configured so as to store the liquid. A separating film 34*a*, for example, polyimide or PTFE, is formed on a liquid facing surface of the upstream tank 34 to prevent air bubbles from entering the upstream tank 34. The upstream tank 34 includes a first pressure sensor 39*a* as a first pressure detection unit.

The downstream tank 35 is disposed downstream of the liquid ejection head 20, and is configured so as to store the liquid. A separating film 35*a*, for example, polyimide or PTFE, is formed on a liquid facing surface of the downstream tank 35 to prevent air bubbles from entering the downstream tank 35. The downstream tank 35 includes a second pressure sensor 39*b* as a second pressure detection unit.

The first pressure sensor 39*a* detects a pressure of the air chamber in the upstream tank 34, and transmits the detected data to the module control unit 38.

The second pressure sensor 39*b* detects a pressure of the air chamber in the downstream tank 35, and transmits the detected data to the module control unit 38.

The first pressure sensor 39*a* and the second pressure sensor 39*b* output pressures as electric signals using, for example, semiconductor piezoresistive pressure sensors. The semiconductor piezoresistive pressure sensor includes a diaphragm which receives an external pressure, and a semiconductor strain gauge formed on the surface of the diaphragm. The semiconductor piezoresistive pressure sensor detects a pressure by converting a change in electric resistance into an electric signal, the change in electric resistance being caused by a piezoresistive effect which occurs in the strain gauge due to deformation of the diaphragm by the external pressure.

The liquid level sensor 54 includes a float 55 which floats on the liquid surface and moves up and down and hole ICs 56*a* and 56*b* provided at two predetermined upper and lower positions. The liquid level sensor 54 detects an amount of ink in the intermediate tank 32 by detecting that the float 55 reaches the upper limit position and the lower limit position with the hole ICs 56*a* and 56*b*, and transmits the detected data to the module control unit 38.

The opening and closing valves 37*a* and 37*b* are respectively provided at the intermediate tank 32 and the downstream tank 35. The opening and closing valves 37*a* and 37*b* may be, for example, normally-closed type solenoid opening and closing valves, which are opened when the power is turned on and are closed when the power is turned off. The opening and closing valves 37*a* and 37*b* are configured to open and close the air chambers of the intermediate tank 32 and the downstream tank 35 to and from the atmosphere as controlled by the module control unit 38.

The first circulation pump 33 is provided on the first flow path 31*a* of the circulation path 31. The first circulation pump 33 is disposed between a portion on a primary side (e.g., right hand side in figure) of the liquid ejection head 20 and the intermediate tank 32 and upstream of the upstream tank 34. The first circulation pump 33 feeds the liquid toward the liquid ejection head 20 disposed downstream of the upstream tank 34.

The second circulation pump 36 is provided on the fourth flow path 31*d* of the circulation path 31. The second circulation pump 36 is disposed between a portion on a secondary side (e.g., left hand side in the figure) of the liquid ejection head 20 and the intermediate tank 32 and downstream of the downstream tank 35. The second circulation pump 36 feeds the liquid toward the intermediate tank 32 disposed downstream of the downstream tank 35.

The supply pump 53 is provided on the supply path 52. The supply pump 53 feeds the ink I stored in the cartridge 51 toward the intermediate tank 32.

The first circulation pump 33, the second circulation pump 36, and the supply pump 53 each include, for example, a piezoelectric pump 60 as illustrated in FIG. 4. The piezoelectric pump 60 includes a pump chamber 58, a piezoelectric actuator 59 which is provided in the pump chamber 58 and vibrates by a voltage, and check valves 61 and 62 which are disposed at an inlet and an outlet of the pump chamber 58. The piezoelectric actuator 59 is configured so as to vibrate at a frequency of, for example, approximately 50 Hz to 200 Hz. The first circulation pump 33, the second circulation pump 36, and the supply pump 53 are connected to a driving circuit by wiring, and are configured so as to be controlled by the control of the module control unit 38. In the piezoelectric pump 60, when the AC voltage is applied to the piezoelectric actuator 59 and the piezoelectric actuator 59 is operated, a volume of the pump chamber 58 changes. In the piezoelectric pump 60, when the applied voltage changes, the maximum change amount of the piezoelectric actuator 59 changes, and thus the volume change amount of the pump chamber 58 changes. When the volume of the pump chamber 58 increases, the check valve 61 at the inlet of the pump chamber 58 is opened, and thus the ink flows into the pump chamber 58. When the volume of the pump chamber 58 decreases, the check valve 62 at the outlet of the pump chamber 58 is opened, and thus the ink flows out from the pump chamber 58. The piezoelectric pump 60 feeds the ink I downstream by repeatedly expanding and contracting the pump chamber 58. Therefore, when the voltage applied to the piezoelectric actuator 59 increases, the liquid feeding capacity increases. When the voltage applied to the piezoelectric actuator 59 decreases, the liquid feeding capacity decreases. For example, in the first embodiment, the voltage applied to the piezoelectric actuator 59 changes between 50 V and 150 V.

As illustrated in FIG. 5, the module control unit 38 includes a CPU 71, driving circuits which drive each component, a storage unit 72 which stores various data, and a communication interface 73 for communication with an external host computer 13. These hardware units of the module control unit 38 are provided on a control board, which is integrated on the circulation device 30. The storage unit 72 includes, for example, a program memory and a RAM. The module control unit 38 may also be referred to as a controller 38.

The module control unit 38 is connected to and communicates with the host computer 13 connected to the host computer 13 via the communication interface 73, and receives various information such as operation conditions.

An input operation by a user or an instruction from the host computer 13 for the ink jet recording apparatus 1 is transmitted to the CPU 71 of the module control unit 38 via the communication interface 73. Various information acquired by the module control unit 38 is input to an application program or transmitted to the host computer 13 of the ink jet recording apparatus 1 via the communication interface 73.

The CPU 71 corresponds to a central processor of the module control unit 38. The CPU 71 controls each hardware unit according to an operating system and an application program to realize various functions of the liquid ejection apparatus.

The CPU 71 is connected to driving circuits 75*a*, 75*b*, and 75*c* which drive the various pumps 33, 36, and 53 of the circulation device 30 and the various sensors 39*a*, 39*b*, and 54.

For example, the CPU 71 can function as a circulation section controlling operations of the circulation pumps 33 and 36 to circulate the ink.

The CPU 71 can function as a supply section controlling an operation of the supply pump 53 based on the information detected by the liquid level sensor 54 and the pressure sensors 39*a* and 39*b*, to supply the ink from the cartridge 51 to the circulation path 31.

Further, the CPU 71 can function as a pressure adjustment section controlling the liquid feeding capacity of the first circulation pump 33 and the liquid feeding capacity of the second circulation pump 36 based on the information detected by the first pressure sensor 39*a*, the second pressure sensor 39*b*, and the liquid level sensor 54, to adjust an ink pressure in the nozzle hole 21*a*.

The storage unit 72 includes, for example, a program memory and a RAM. The storage unit 72 stores an application program and various setting values. The storage unit 72 stores various setting values such as a formula for calculating the ink pressure in the nozzle hole 21*a*, a target pressure range, and a maximum adjustment value of each pump, as control data to be used for pressure control.

Hereinafter, a liquid ejection method of the liquid ejection apparatus 10 and a control method of the liquid ejection apparatus 10 according to the second embodiment will be described with reference to the flowchart of FIG. 6.

In Act 1, the CPU 71 waits for an instruction to start circulation. For example, when an instruction to start circulation is detected by a command from the host computer 13, the process proceeds to Act 2. As a printing operation, the host computer 13 controls the liquid ejection head 20 ejecting an ink toward the recording medium S while the liquid ejection apparatus 10 reciprocates in a direction perpendicular to a direction in which the medium support mechanism 12 moves the recording medium S. Specifically, the CPU 71 controls the head support mechanism 11 transporting a carriage 11*a* toward the recording medium S, and reciprocating the carriage 11*a* in the direction of the arrow A. The CPU 71 transmits an image signal according to the desired image to a driving circuit 75*e* of the liquid ejection head 20. The driving circuit 75*e* selectively drives the actuator 24 of the liquid ejection head 20, and ejects ink droplets from the nozzle hole 21*a* onto the recording medium S.

In Act 2, the CPU 71 controls the first circulation pump and the second circulation pump 36 starting an ink circulation operation. The ink I circulates from the intermediate tank 32, through the upstream tank 34, into the liquid ejection head 20, and flow back into the intermediate tank 32 via the downstream tank 35. By this circulation operation, impurities included in the ink I are removed by a filter provided in the circulation path 31.

In Act 3, the CPU 71 controls the opening and closing valve 37 opening such that the intermediate tank 32 is opened to the atmosphere. Since the intermediate tank 32 is opened to the atmosphere and thus maintains a constant pressure, a pressure drop in the circulation path due to ink consumption of the liquid ejection head 20 can be prevented. When there is a concern that a temperature of the intermediate tank 32 may increase due to the opening and closing valve 37 being open for an extended period of time, the opening and closing valve 37 may be periodically opened for a brief period of time. If the pressure in the circulation path does not excessively decrease, the ink pressure in the nozzle can be maintained constant while the opening and closing valve 37 is closed. The solenoid opening and closing valve 37 is a normally-closed type valve. Thus, even when supply of the power to the apparatus suddenly stops due to a power failure or the like, the opening and closing valve 37 is instantaneously closed. Consequently, the intermediate tank 32 can be blocked from an atmospheric pressure and the circulation path 31 can be sealed. Therefore, it is possible to prevent the ink I from dropping from the nozzle hole 21*a* of the liquid ejection head 20.

In Act 4, the CPU 71 detects upstream pressure data and downstream pressure data transmitted from the first pressure sensor 39*a* and the second pressure sensor 39*b*. The CPU 71 further detects a liquid level of the intermediate tank 32 based on data transmitted from the liquid level sensor 54.

In Act 5, the CPU 71 starts a liquid level adjustment. Specifically, the CPU 71 controls the supply pump 53 supplying the ink from the cartridge 51 based on the detection result of the liquid level sensor 54, thereby adjusting a liquid level position. For example, at the time of printing, ink droplets ID are ejected from the nozzle hole 21*a*, and the ink amount of the intermediate tank 32 instantaneously decreases. When the liquid level falls, the ink is supplied. When the ink amount again increases and output of the liquid level sensor 54 reverses, the CPU 71 controls the supply pump 53 stopping supply the ink to the intermediate tank 32.

In Act 6, the CPU 71 detects the ink pressure in the nozzle from the pressure data. Specifically, based on the upstream pressure data and the downstream pressure data transmitted from the pressure sensor, the ink pressure in the nozzle hole 21*a* is calculated using a predetermined formula.

For example, the ink pressure $P_n$ of the nozzle can be obtained by adding a pressure $\rho_{gh}$ which is generated due to a height difference between liquid levels of the upstream tank 34 and the downstream tank 35, and a surface of the nozzle, to an average value of a pressure value $P_h$ of the air chamber of the upstream tank 34 and a pressure value $P_l$ of the air chamber of the downstream tank 35. Here, ρ is a density of the ink, g is a gravity acceleration, and h is a height distance between the liquid levels of the upstream tank 34 and the downstream tank 35, and the surface of the nozzle. The separating film 34*a* and the separating film 35*a* are located at liquid levels of the upstream tank 34 and the downstream tank 35, respectively. The separating film 34*a* and the separating film 35*a* may be located at the same height.

As a pressure adjustment process, the CPU 71 calculates a driving voltage based on the ink pressure $P_n$ of the nozzle that is calculated from the pressure data. The CPU 71 controls the first circulation pump 33 and the second circulation pump 36 such that the ink pressure $P_n$ of the nozzle becomes an appropriate value. Thus, it is possible to prevent the ink I from leaking from the nozzle hole 21*a* of the liquid ejection head 20, while maintaining a negative pressure at the nozzle hole. However, the negative pressure is maintained low enough not to draw air bubbles from the nozzle hole into the intermediate tank 32 such that the nozzle hole maintains a meniscus Me. Here, as an example, it is assumed that the upper limit of a target value is $P_{1H}$ and the lower limit of a target value is $P_{1L}$.

In Act 7, the CPU 71 determines whether the ink pressure $P_n$ of the nozzle is within an appropriate range, that is, whether $P_{1L} \leq P_n \leq P_{1H}$ is satisfied. When the ink pressure $P_n$ of the nozzle is not within the appropriate range (No in Act 7), in Act 8, the CPU 71 determines whether or not the ink pressure $P_n$ of the nozzle exceeds the upper limit $P_{1H}$ of the target value.

The ink pressure in the nozzle of the liquid ejection head 20 is increased when the first circulation pump 33 is driven more strongly than the second circulation pump 36, and is decreased when the second circulation pump 36 is driven more strongly than the first circulation pump 33.

Further, the CPU 71 determines whether or not the driving voltages are within adjustment ranges (between a minimum driving voltage and a maximum driving voltage) of the first circulation pump 33 and the second circulation pump 36, respectively (Act 9 and Act 12). When either of the driving voltages of the first circulation pump 33 and the second circulation pump 36 exceed maximum adjustment values Vmax of the pumps 33 and 36, the CPU 71 increases or decreases the ink pressure in the nozzle by changing a driving voltage of the pump 36 or the pump 33, the driving voltage of which does not exceed the maximum adjustment value Vmax.

More specifically, when the ink pressure $P_n$ of the nozzle is not within the appropriate range (No in Act 7), and the ink pressure $P_n$ of the nozzle does not exceed the upper limit of the target value $P_{1H}$ (No in Act 8), that is, when the ink pressure $P_n$ of the nozzle is lower than the upper limit of the target value $P_{1H}$, in Act 9, the CPU 71 determines whether or not the driving voltage V+ of the first circulation pump 33 is equal to or greater than the maximum adjustment value Vmax, that is, exceeds the adjustable range of the first circulation pump 33. When the driving voltage V+ of the first circulation pump 33 is equal to or greater than the maximum adjustment value Vmax (Yes in Act 9), in Act 10, the CPU 71 increases the ink pressure in the nozzle by decreasing the driving voltage of the second circulation pump. When the driving voltage V+ of the first circulation pump 33 is less than the maximum adjustment value Vmax and is within the adjustable range (No in Act 9), in Act 11, the CPU 71 increases the ink pressure in the nozzle by increasing the driving voltage of the first circulation pump 33.

In Act 8, when the ink pressure $P_n$ of the nozzle exceeds the upper limit of the target value $P_{1H}$ (Yes in Act 8), in Act 12, the CPU 71 determines whether or not the driving voltage V− of the second circulation pump 36 is equal to or greater than the maximum adjustment value Vmax, that is, exceeds the adjustment range of the second circulation pump 36. When the driving voltage V− of the second circulation pump 36 is equal to or greater than the maximum adjustment value Vmax (Yes in Act 12), in Act 13, the CPU 71 decrease the ink pressure in the nozzle by decreasing the driving voltage of the first circulation pump 33. When the driving voltage V− of the second circulation pump 36 is less than the maximum adjustment value Vmax and is within the adjustable range (No in Act 12), in Act 14, the CPU 71 decreases the ink pressure in the nozzle by increasing the driving voltage of the second circulation pump 36.

In Act 15, the CPU 71 performs a feedback control of Act 4 to Act 14 until a circulation end instruction is detected. When a circulation end instruction is detected by a command from the host computer 13 (Yes in Act 15), the CPU 71 controls the opening and closing valve 37 closing to seal the intermediate tank 32 (Act 16). The CPU 71 controls the first circulation pump 33 and the second circulation pump 36 stopping to end the circulation process (Act 17).

The liquid ejection apparatus 10 described above detects an upstream pressure and a downstream pressure of the liquid ejection head 20, and performs the feedback control of the pressure on the first circulation pump 33 and the second circulation pump 36. Thus, the ink pressure in the nozzle can be maintained at an appropriate level. Therefore, for example, even when a pump degrades in quality over time, an appropriate pressure control can be realized.

In the liquid ejection apparatus 10, since the piezoelectric pump 60 is used as the circulation pumps 33 and 36, a structure can be simple and material selection can be easy. The piezoelectric pump 60 does not require a large driving source such as a motor or a solenoid, and thus the size of the piezoelectric pump 60 can be smaller than that of a general diaphragm pump, a piston pump, or a tube pump. Further, for example, when a tube pump is used, there is a possibility that the tube and the ink come into contact with each other, and thus it is necessary to select a material that does not cause deterioration of the tube or the ink. However, when the piezoelectric pump 60 is used, the material selection can be easy. For example, liquid-contact components of the piezoelectric pump 60 may be SUS 316L, PPS, PPA, or polyimide having excellent chemical resistance.

In the first embodiment, the upstream first circulation pump 33 can increase pressure when the driving voltage increases, and decrease pressure when the driving voltage decreases. The downstream second circulation pump 36 can decrease pressure when the driving voltage increases, and increase pressure on the nozzle when the driving voltage decreases. Thus, when the driving voltage exceeds the adjustable range of one circulation pump, the circulation pump on the other side can be used. Therefore, a high-precision control can be realized. Further, the first circulation pump 33, the second circulation pump 36, the supply pump 53, the pressure sensors 39*a* and 39*b*, the liquid level sensor 54, the control board, and functions which are required for controlling ink supply, ink circulation, and ink pressure adjustment are integrated in the circulation device 30. Therefore, as compared with a large-sized stationary type circulation device, it is possible to simplify connection of the flow path and electrical connection between a main body of the ink jet recording apparatus 1 and the carriage 11*a*. Therefore, it is possible to reduce the size, the weight, and the cost of the ink jet recording apparatus 1.

Since the components required for the feedback control are integrated on the control board in the liquid ejection apparatus 10, only information data such as an operation instruction or a state notification that does not require such a high-speed response passes through the communication interface 73. Thus, it is also possible that a requirement for a data transfer rate of the communication interface 73 can be relaxed.

Second Embodiment

Figure 7:
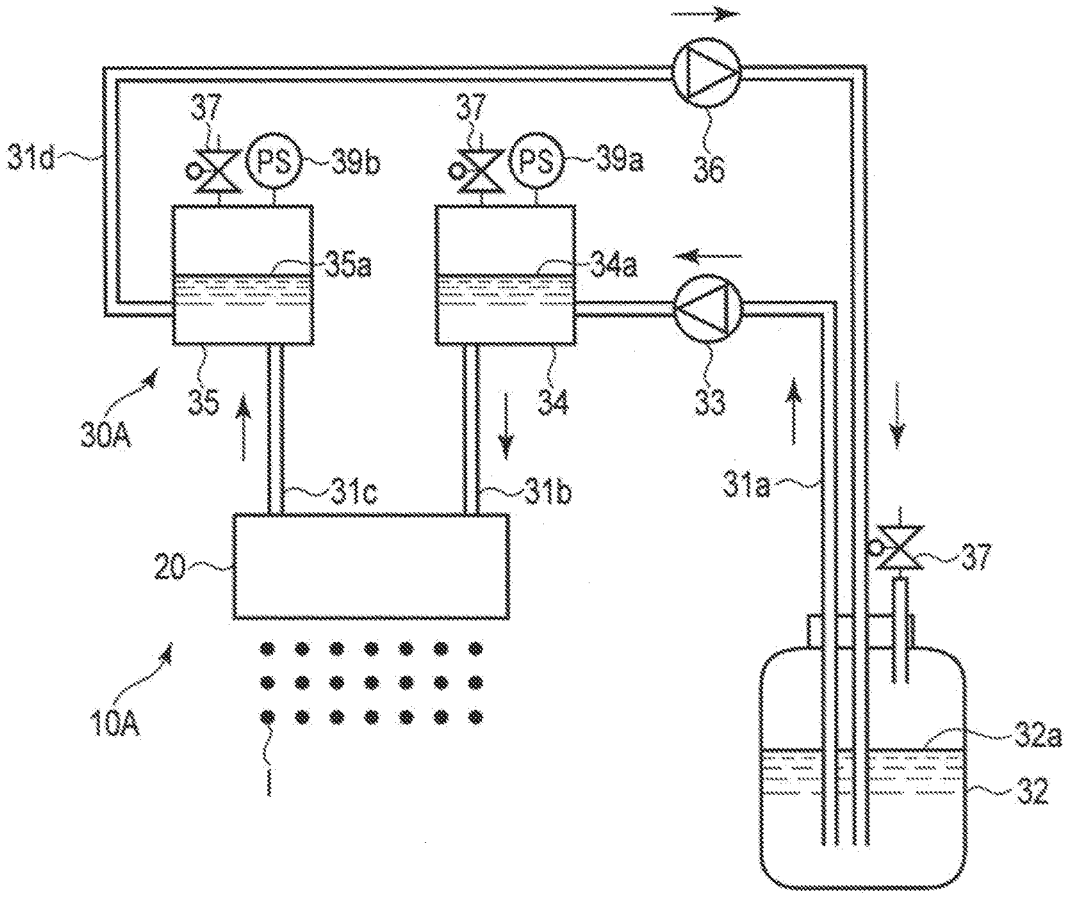
FIG. 7 is an explanatory diagram illustrating a configuration of a liquid ejection apparatus according to another embodiment.

Hereinafter, a liquid ejection apparatus 10A according to a second embodiment will be described with reference to FIG. 7. FIG. 7 is an explanatory diagram illustrating a configuration of the liquid ejection apparatus 10A. The liquid ejection apparatus 10A according to the second embodiment is the same as the liquid ejection apparatus 10 according to the first embodiment except that the cartridge 51 is used as the intermediate tank 32. Substantially similar aspect of liquid ejection apparatus 10A (illustrated in FIG. 7) are denoted by the same reference numerals as those of the liquid ejection apparatus 10 (illustrated in FIG. 2), and a detailed description of these aspects will be omitted.

As illustrated in FIG. 7, in the liquid ejection apparatus 10A according to the second embodiment, in place of the cartridge 51 in the first embodiment, the intermediate tank 32, which can be opened to the atmosphere, is disposed in the circulation path 31 between the upstream tank 34 and the downstream tank 35. The intermediate tank 32 may be opened to the atmosphere permanently. In the second embodiment, the same effect as that of the first embodiment can be obtained. Further, the cartridge 51 can be used as the intermediate tank 32, and thus the structure can be simplified.

The configuration of the liquid circulation devices according to the above-described embodiments is not limited. The liquid ejection apparatuses 10 and 10A can eject a liquid other than an ink, for example, a liquid including conductive particles for forming a wiring pattern of a printed wiring board, or the like may be used.

The liquid ejection head 20 may have a structure which ejects ink droplets by deforming the diaphragm using static electricity, or a structure which ejects ink droplets from a nozzle using thermal energy of a heater or the like, in addition to the above-described structures.

In the above-described embodiments, an example in which the liquid ejection apparatus is used in the ink jet recording apparatus 1 is described. However, the liquid ejection apparatus is not limited thereto. For example, the liquid ejection apparatus may be used for 3D printers, industrial manufacturing machines, and medical applications. In this case, the size, the weight, and the cost of the apparatus may be reduced.

As the first circulation pump 33, the second circulation pump 36, and the supply pump 53, for example, a tube pump, a diaphragm pump, a piston pump, or the like may be used in place of the piezoelectric pump 60.

Figure 8:
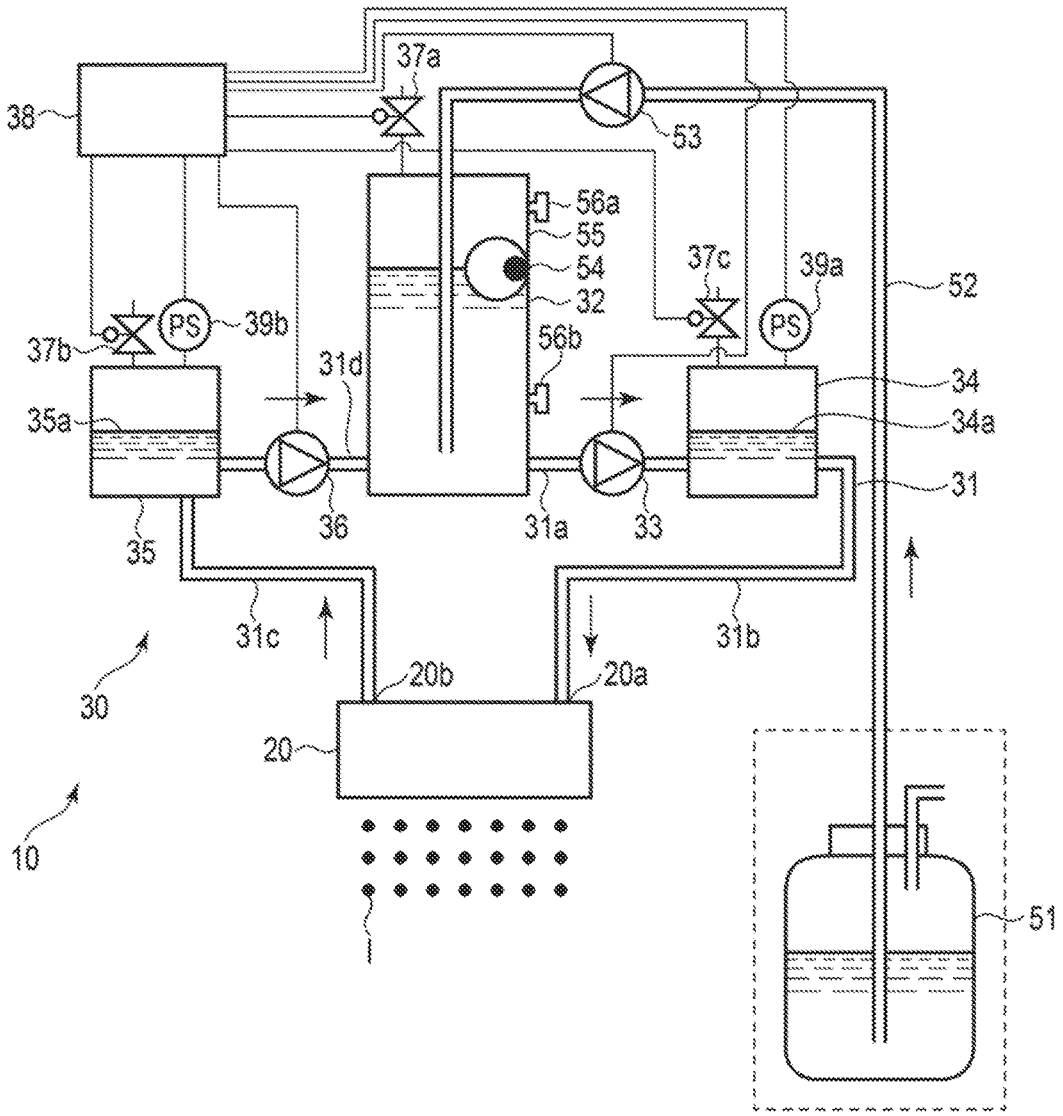
FIG. 8 is an explanatory diagram illustrating a configuration of a liquid ejection apparatus according to another embodiment.

In the first embodiment, an example is described in which separation films 32*a*, 34*a*, and 35*a* are respectively formed on a liquid surface in the intermediate tank 32, the upstream tank 34, and the downstream tank 35. However, the liquid ejection apparatus is not limited thereto, and the separating films 32*a*, 34*a*, and 35*a* may be omitted. For example, in some embodiments, there may not be a separation film formed on a liquid surface of the intermediate tank 32, as shown in FIG. 8, allowing the liquid surface to be in contact with the air chamber in the intermediate tank 32. Such a structure may allow easy removal of air bubbles formed on the liquid surface of the intermediate tank 32.

In the first embodiment, an example in which the intermediate tank 32 has an opening and closing valve 37*a*, and the downstream tank 35 has an opening and closing valve 37*b* is described. However, the liquid ejection apparatus is not limited thereto. For example, in some embodiments, the upstream tank 34 may have an opening and closing valve 37*c*, controlled by the controller 38.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid circulation device for connection with a liquid ejection head, comprising:

a circulation path through which a liquid circulates to and from the liquid ejection head;

a first pump in the circulation path on a first side of the liquid ejection head;

a second pump in the circulation path on a second side of the liquid ejection head;

an adjustment tank in the circulation path between the first pump and the second pump;

an upstream tank in the circulation path between the liquid ejection head and the first pump;

a downstream tank in the circulation path between the liquid ejection head and the second pump;

a first pressure sensor configured to detect a pressure in the upstream tank;

a second pressure sensor configured to detect a pressure in the downstream tank; and a controller connected to the first and second pumps and configured to control the first and second pumps based on detected pressures in the upstream and downstream tanks, wherein the controller is configured to:

increase pressure in the liquid ejection head by increasing a first driving voltage applied to a piezoelectric body of the first pump until the first driving voltage reaches a maximum first driving voltage, and then decrease a second driving voltage applied to a piezoelectric body of the second pump after the first driving voltage reaches the maximum first driving voltage, and decrease pressure in the liquid ejection head by increasing the second driving voltage until the second driving voltage reaches a maximum second driving voltage, and then decrease the first driving voltage after the second driving voltage reaches the maximum second driving voltage.

2. The liquid circulation device according to claim 1, wherein the downstream tank includes a valve that is openable to atmosphere.

3. The liquid circulation device according to claim 1, further comprising:

a first valve connected to the adjustment tank and openable to atmosphere; and a second valve connected to the downstream tank and openable to atmosphere.

4. The liquid circulation device according to claim 1, wherein the first pump and the second pump are each a piezoelectric pump.

5. The liquid circulation device according to claim 1, further comprising:

a supply tank for storing the liquid outside of the circulation path and connected to the adjustment tank via a supply line;

a third pump provided in the supply line for feeding the liquid to the adjustment tank from the supply tank; and a liquid level sensor configured to detect an amount of the liquid in the adjustment tank, wherein the controller is further configured to control an operation of the third pump based on the detected amount of the liquid in the adjustment tank.

6. The liquid circulation device according to claim 1, further comprising a separating film on a liquid facing surface of each of the upstream tank, the downstream tank, and the adjustment tank, or each of the upstream tank and the downstream tank.

7. The liquid circulation device according to claim 1, wherein the adjustment tank is a cartridge.

8. A liquid ejection apparatus, comprising:

a liquid ejection head;

a circulation path through which a liquid circulates to and from the liquid ejection head;

a first pump in the circulation path on a first side of the liquid ejection head;

a second pump in the circulation path on a second side of the liquid ejection head;

an adjustment tank in the circulation path between the first pump and the second pump;

an upstream tank in the circulation path between the liquid ejection head and the first pump;

a downstream tank in the circulation path between the liquid ejection head and the second pump;

a first pressure sensor configured to detect a pressure in the upstream tank;

a second pressure sensor configured to detect a pressure in the downstream tank; and a controller connected to the first and second pumps and configured to control the first and second pumps based on detected pressures in the upstream tank and the downstream tank, wherein the controller is configured to:

increase pressure in the liquid ejection head by increasing a first driving voltage applied to a piezoelectric body of the first pump until the first driving voltage reaches a maximum first driving voltage, and then decrease a second driving voltage applied to a piezoelectric body of the second pump after the first driving voltage reaches the maximum first driving voltage, and decrease pressure in the liquid ejection head by increasing the second driving voltage until the second driving voltage reaches a maximum second driving voltage, and then decrease the first driving voltage after the second driving voltage reaches the maximum second driving voltage.

9. The liquid ejection apparatus according to claim 8, wherein the downstream tank includes a valve that is openable to atmosphere.

10. The liquid ejection apparatus according to claim 8, further comprising:

a first valve connected to the adjustment tank and openable to atmosphere; and a second valve connected to the downstream tank and openable to atmosphere.

11. The liquid ejection apparatus according to claim 8, wherein the first pump and the second pump are each a piezoelectric pump.

12. The liquid ejection apparatus according to claim 8, further comprising:

a supply tank for storing the liquid outside of the circulation path and connected to the adjustment tank via a supply line;

a third pump provided in the supply line for feeding the liquid to the adjustment tank from the supply tank; and a liquid level sensor configured to detect an amount of the liquid in the adjustment tank, wherein the controller is further configured to control an operation of the third pump based on the detected amount of the liquid in the adjustment tank.

13. The liquid ejection apparatus according to claim 8, further comprising a separating film on a liquid facing surface of each of the upstream tank, the downstream tank, and the adjustment tank, or each of the upstream tank and the downstream tank.

14. The liquid ejection apparatus according to claim 8, wherein the adjustment tank is a cartridge.

15. A liquid ejection method, comprising:

detecting a pressure in an upstream tank on a first side of a liquid ejection head in a circulation path, through which a liquid circulates to and from the liquid ejection head and an adjustment tank;

detecting a pressure in a downstream tank on a second side of the liquid ejection head in the circulation path;

controlling a first pump and a second pump based on detected pressures in the upstream and downstream tanks;

increasing pressure in the liquid ejection head by increasing a first driving voltage applied to a piezoelectric body of the first pump until the first driving voltage reaches a maximum first driving voltage, and then decreasing a second driving voltage applied to a piezoelectric body of the second pump after the first driving voltage reaches the maximum first driving voltage; and decreasing pressure in the liquid ejection head by increasing the second driving voltage until the second driving voltage reaches a maximum second driving voltage, and then decreasing the first driving voltage after the second driving voltage reaches the maximum second driving voltage, wherein the first pump is on the first side of the liquid ejection head between the adjustment tank and the upstream tank in the circulation path, and the second pump is on the second side of the liquid ejection head between the downstream tank and the adjustment tank in the circulation path.

16. The liquid ejection method according to claim 15, wherein the first pump and the second pump are piezoelectric pumps.

17. The liquid ejection method according to claim 15, further comprising:

detecting an amount of liquid in the adjustment tank; and controlling a feeding of the liquid from a supply tank to the adjustment tank the detected amount of the liquid in the adjustment tank.

* * * * *